US009988865B2

(12) United States Patent
Mansell et al.

(10) Patent No.: US 9,988,865 B2
(45) Date of Patent: Jun. 5, 2018

(54) TWO PHASE MUD FLOW USAGE WITH DUAL-STRING DRILLING SYSTEM

(71) Applicant: Halliburton Energy Services, Inc., Houston, TX (US)

(72) Inventors: Arthur G. Mansell, Scotland (GB); Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 401 days.

(21) Appl. No.: 14/765,487

(22) PCT Filed: Feb. 6, 2013

(86) PCT No.: PCT/US2013/024955
§ 371 (c)(1),
(2) Date: Aug. 3, 2015

(87) PCT Pub. No.: WO2014/123524
PCT Pub. Date: Aug. 14, 2014

(65) Prior Publication Data
US 2015/0361746 A1 Dec. 17, 2015

(51) Int. Cl.
*E21B 17/18* (2006.01)
*E21B 21/08* (2006.01)
(Continued)

(52) U.S. Cl.
CPC ..... *E21B 21/08* (2013.01); *E21B 17/18* (2013.01); *E21B 21/10* (2013.01); *E21B 21/12* (2013.01);
(Continued)

(58) Field of Classification Search
CPC ..... E21B 33/12; E21B 21/10; E21B 21/12
See application file for complete search history.

(56) References Cited

U.S. PATENT DOCUMENTS 1,502,372 A * 7/1924 Callanan, Jr. ..... E21B 33/128 277/341
3,638,742 A 2/1972 Wallace
(Continued)

FOREIGN PATENT DOCUMENTS

WO 2011/161250 A2 12/2011

OTHER PUBLICATIONS

"Extended Reach Drilling (ERD) Reelwell Drilling Method" brochure, Apr. 1, 2011.
(Continued)

*Primary Examiner* — D. Andrews
*Assistant Examiner* — Dany E Akakpo
(74) *Attorney, Agent, or Firm* — John Wustenberg; Baker Botts L.L.P.

(57) ABSTRACT

Systems and methods for controlling fluid contact with a borehole wall during drilling operations include introducing an outer pipe into a borehole and positioning an inner pipe within the outer pipe, wherein the inner pipe may be axially disposed within the outer pipe. The annular isolator may be disposed within an annulus between the outer pipe and the borehole wall. The method may include placing a control fluid in the annulus between the outer pipe and the borehole wall. The method may further include circulating a drilling fluid to a drill bit using the inner pipe and the annulus between the inner pipe and the outer pipe. The drilling fluid may be separated from the control fluid by an annular isolator.

19 Claims, 7 Drawing Sheets

(51) Int. Cl.

| | |
|---|---|
| ***E21B 21/12*** | (2006.01) |
| ***E21B 33/124*** | (2006.01) |
| ***E21B 33/127*** | (2006.01) |
| ***E21B 33/126*** | (2006.01) |
| ***E21B 21/10*** | (2006.01) |

(52) U.S. Cl.
CPC ..... *E21B 33/124* (2013.01); *E21B 33/126* (2013.01); *E21B 33/127* (2013.01); *E21B 33/1243* (2013.01)

(56) References Cited

U.S. PATENT DOCUMENTS

| | | | | |
|---|---|---|---|---|
| 4,057,118 | A | 11/1977 | Ford | |
| 4,534,426 | A | 8/1985 | Hooper | |
| 5,303,774 | A * | 4/1994 | Duhn | E21B 33/1212 166/191 |
| 9,187,968 | B2 * | 11/2015 | Hole | E21B 17/18 |
| 2005/0000731 | A1 | 1/2005 | Nguyen et al. | |
| 2009/0025930 | A1 | 1/2009 | Iblings et al. | |
| 2009/0101413 | A1 | 4/2009 | Abt et al. | |
| 2012/0012342 | A1 * | 1/2012 | Wilkin | E21B 33/1243 166/387 |

OTHER PUBLICATIONS

International Search Report issued in related PCT Application No. PCT/US2013/024955 dated Nov. 13, 2013, 5 pages.
International Preliminary Report on Patentability issued in related PCT Application No. PCT/US2013/024955, dated Aug. 20, 2015 (7 pages).

* cited by examiner

TWO PHASE MUD FLOW USAGE WITH DUAL-STRING DRILLING SYSTEM

CROSS-REFERENCE TO RELATED APPLICATION

The present application is a U.S. National Stage Application of International Application No. PCT/US2013/024955 filed Feb. 6, 2013, which is incorporated herein by reference in its entirety for all purposes.

BACKGROUND

The present disclosure relates generally to well drilling operations and, more particularly, to a method and system for controlling fluid contact with a borehole wall during wellbore operations.

During the course of a typical well drilling operation, the drill bit creates a hole with a somewhat larger diameter than the diameter of the corresponding drill string, creating an annular space between the drill string and borehole wall. During most drilling operations, this annular space must be filled to maintain integrity of the drilling operation. For example, a fluid placed in the annular space may be used to compensate for the pressure differential between the drill string interior and the annular space. In addition, the fluid placed in the annular fluid may be used to maintain formation pressure, which lowers the stress on the rock and thereby maintains the integrity of the formation.

Well drilling operations may require drilling through a variety of geological formations of differing properties. These formations can also be sensitive to particular conditions. Where the properties of one fluid might contribute to the integrity of one type of formation, that same fluid might be destructive to a second formation. These competing geological formations may present a challenge to a well drilling operation when both must be drilled through to reach the goal. The importance of managing the chemistry of fluid exposed to geological formations increases as the depth of the desired well increases, thereby increasing the length of exposure to adverse fluids and increasing the risk of formation collapse.

FIGURES

Some specific exemplary embodiments of the disclosure may be understood by referring, in part, to the following description and the accompanying drawings.

Figure 1:
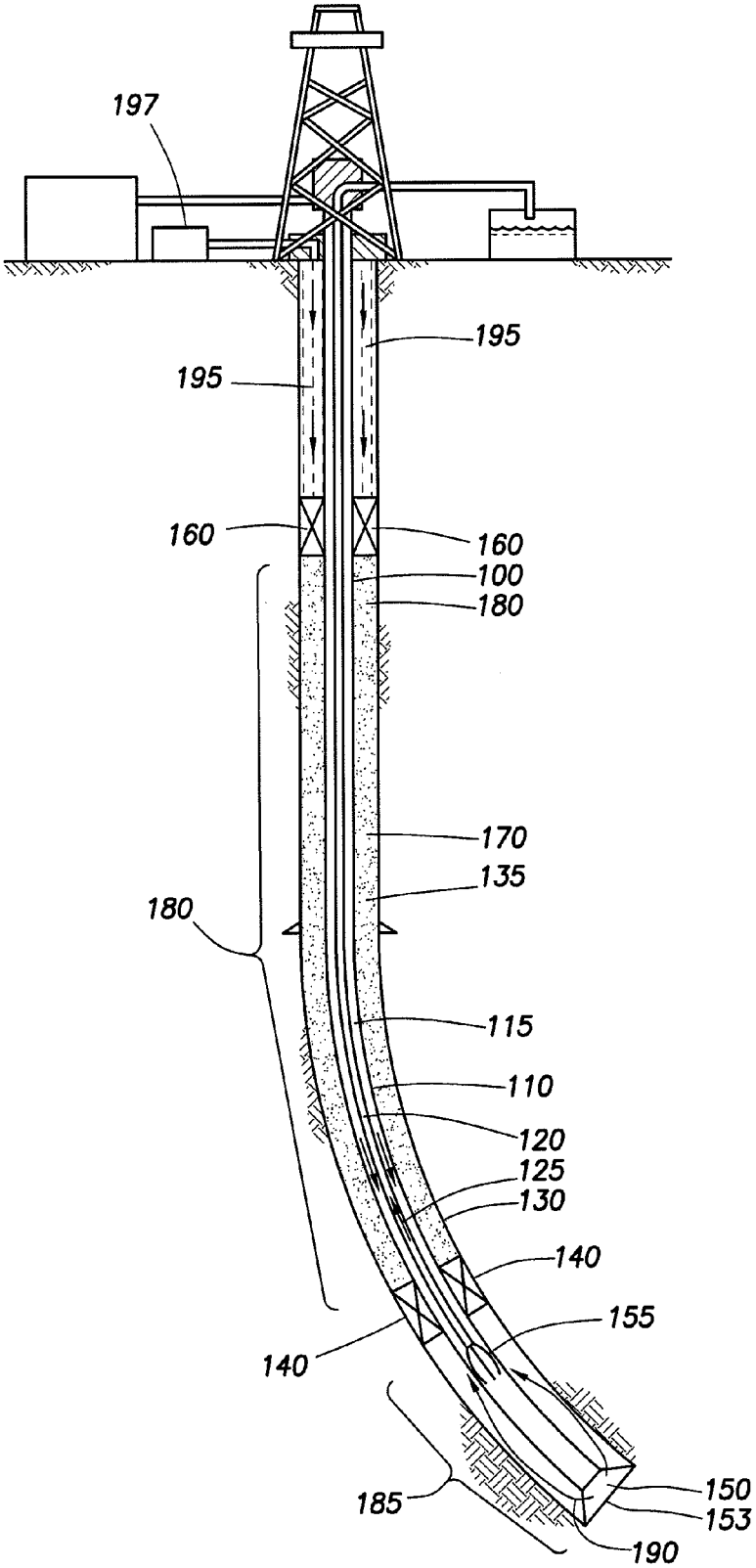
FIG. 1 illustrates an example drilling system with a controlled fluid zone created by an annular isolator, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to a method and system for controlling fluid contact with a borehole wall during wellbore operations.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or direct connection. Thus, if a first device couples to a second device, that connection may be through a direct connection, or through an indirect mechanical or electrical connection via other devices and connections. The term "uphole" as used herein means along the drillstring or the hole from the distal end towards the surface, and "downhole" as used herein means along the drillstring or the hole from the surface towards the distal end.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

According to aspects of the present disclosure, systems and methods for controlling fluid contact with a borehole wall during wellbore operations. The method may include introducing an outer pipe into a borehole and positioning an inner pipe within the outer pipe. As seen in FIG. 1, the inner pipe may be axially disposed within the outer pipe. A drill bit may be coupled to the distal end of the drilling system and a liner piston may be coupled to the outer pipe. A hydraulic pump may be used to place force on a hydraulic fluid located uphole of the liner piston. This dual-string drilling column setup is similar to the ReelWell method of ReelWell AS (Norway). In certain embodiments, the borehole is filled with oil-based mud before a packer is set, then water-based mud is used for a drilling fluid.

The method may further include coupling an annular isolator to the outer pipe. As seen in FIG. 1, the annular isolator may be disposed within an annulus between the outer pipe and the borehole wall. As will be described in greater detail below, the annular isolator may be expandable or non-expandable. In certain embodiments, a plurality of annular isolators may be disposed within the annulus between the outer pipe and the borehole wall.

The method may further include placing a control fluid in the annulus between the outer pipe and the borehole wall. In certain embodiments, a plurality of annular isolators may create a plurality of control zones along the borehole. The plurality of control zones may be substantially isolated from one another to allow placement of a separate control fluid in each control zone, if desired. As will be described below, in certain embodiments, a plurality of control fluid communication controllers may be used to selectively place a plurality of control fluids in designated control zones, where the control fluids may have individual and distinct characteristics. Each control fluid communication controller may be associated with a respective control zone to more accurately control the fluid type in each control zone. Advantageously, as will be described below, selective placement of control fluids into targeted control zones may allow a complementary control fluid to be chosen based on the composition of a given borehole wall section. As will be described below, the control fluid may be kept substantially in place during wellbore operations, allowing the borehole wall to maintain contact with a control fluid of consistent properties during the course of wellbore operations. In certain embodiments, the control fluid may be kept substantially in place by moving the plurality of control fluids between the plurality of control zones as the drilling operation progresses. In certain embodiments, the control fluid may be kept substantially in place by sliding annular isolators axially as the drilling operation progresses.

The method may further include circulating a drilling fluid to a drill bit using the inner pipe and the annulus between the inner pipe and the outer pipe. The drilling fluid may be separated from the control fluid by an annular isolator. In certain embodiments, the drilling fluid may be circulated to the drill bit through the inner pipe and returned through the annulus between the inner pipe and the outer pipe. In certain embodiments, the drilling fluid may be circulated to the drill bit through the annulus between the inner pipe and the outer pipe and returned through the inner pipe.

FIG. 1 shows an example drilling system 100, according to aspects of the present disclosure. The drilling system 100 comprises an outer pipe 110 and an inner pipe 120 axially disposed within the outer pipe 110. A liner piston 160 may be coupled to the outer pipe 110 and located in the borehole annulus 135. During drilling operations, a hydraulic fluid 195 may be placed uphole of the liner piston 160. A hydraulic pump 197 may place a force on the hydraulic fluid 195, thereby placing a force on the liner piston 160. An annular isolator 140 is disposed on the outer pipe 110 and located in the borehole annulus 135 formed between the outer pipe 110 and the borehole wall 130. The annular isolator 140 and the liner piston 160 may create a control fluid zone 180. A drilling fluid contact zone 185 may be formed between an annular isolator 140 and the wellbore distal end 153, where the borehole wall 130 currently located in the drilling fluid contact zone 185 is in contact with drilling fluid 190 during drilling operations. A control fluid 170 may be placed in the borehole annulus 135, in a control fluid zone 180, where an annular isolator 140 may substantially separate the control fluid 170 from the drilling fluid 190. In certain embodiments, the annular isolator 140 may be placed just uphole of the flow diverter 155 to minimize the size of the drilling fluid contact zone 185. The liner piston separates the control fluid 170 from the hydraulic fluid 195. As will be appreciated by one of ordinary skill in the art in view of this disclosure, a control fluid may be chosen with properties designed to reduce the probability that the integrity in the borehole wall will be compromised. The properties of a desired control fluid may change to accommodate various geological formations. It is appreciated that a control fluid of any type may be chosen for use in the present invention. As will be discussed below, certain embodiments may allow selective use of a plurality of control fluids with differing properties in situations where the geological formation is varied along the length of the borehole.

In certain embodiments, the drilling fluid may be circulated to the drill bit 150 through the inner pipe 120 and returned through the annulus between the inner pipe and the outer pipe 115. In certain embodiments, the drilling fluid may be circulated to the drill bit 150 through the annulus between the inner pipe and the outer pipe 115 and returned through the inner pipe 120. A flow diverter 155 may be used to direct fluid flow within the inner pipe 120 to the drilling fluid contact zone 185. The flow diverter 155 may be used to separate the inlets and outlets of the inner pipe 120 and the outer pipe 110 to allow the drilling fluid to carry cuttings to the uphole end.

Figure 2A:
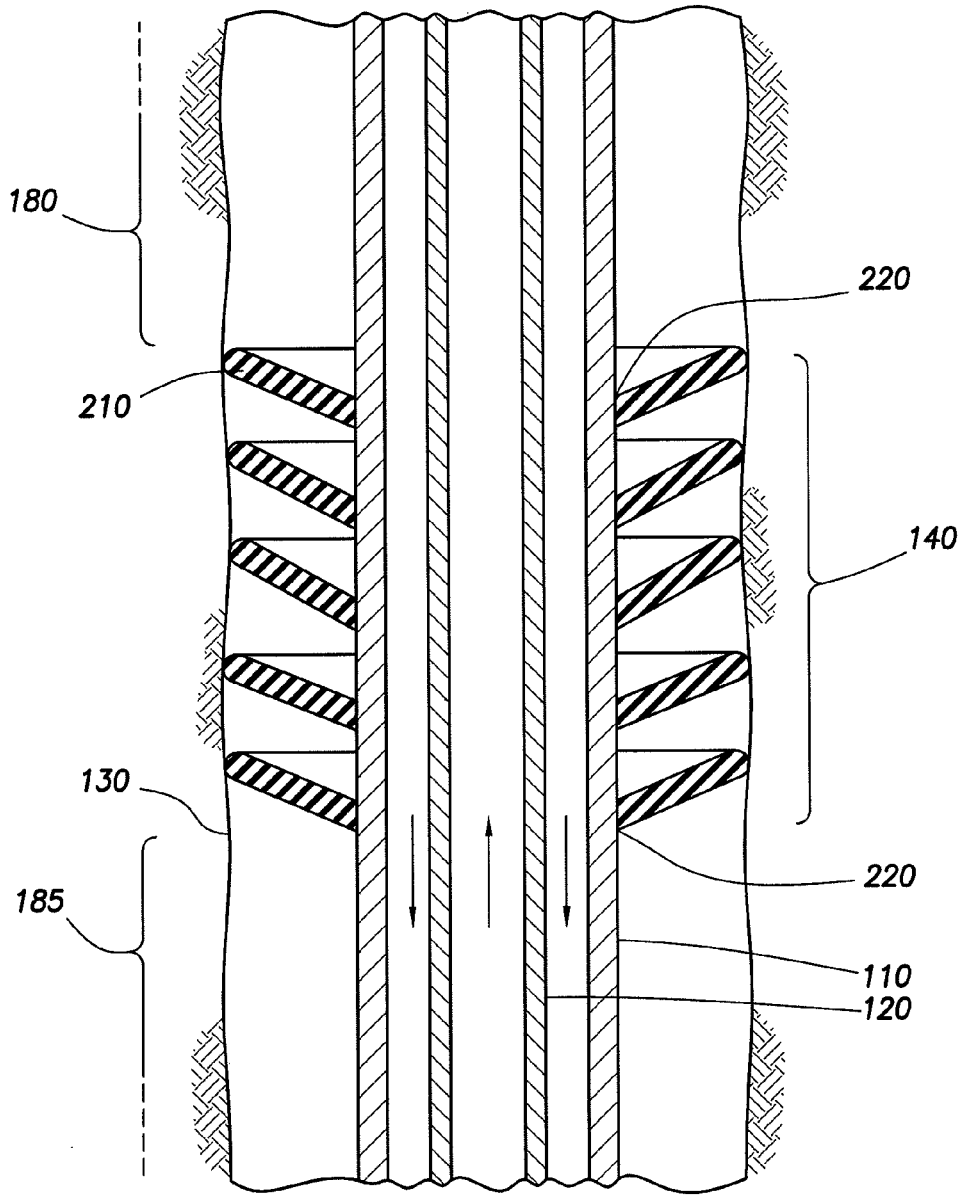
FIG. 2A illustrates an example non-expandable annular isolator, according to aspects of the present disclosure. (B) illustrates a top-down view of an example non-expandable annular isolator.
Figure 2B:
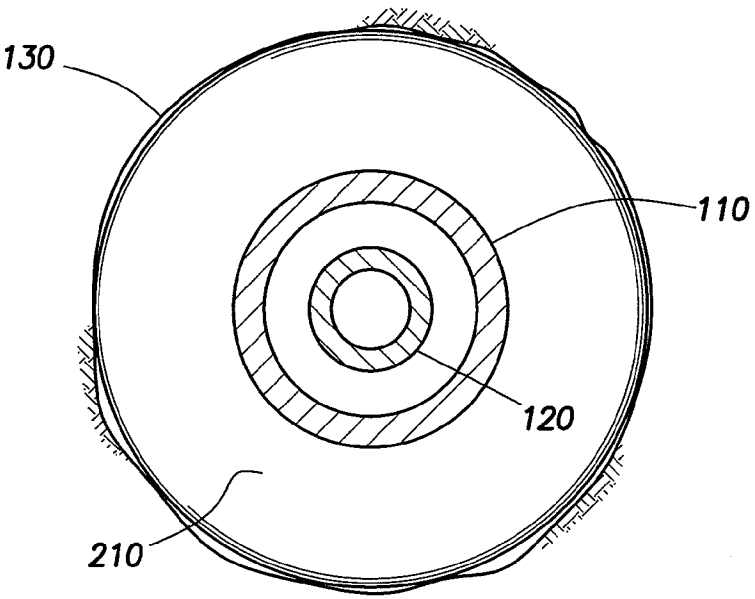

FIG. 2A illustrates an example annular isolator 140 that is non-expandable. The annular isolator 140 may be coupled to the outer pipe 110 at a plurality of annular isolator coupling points 220. The annular isolator coupling points 220 may allow the annular isolator 140 to rotate around the outer pipe 110. In certain embodiments, the annular isolator coupling points 220 may allow the annular isolator 140 to move axially along the outer pipe 110, downhole or uphole. The annular isolator 140 may be torsionally decoupled from the outer pipe 110 while the annular isolator 140 continues to maintain its sealing capability. The annular isolator 140 may be made up of a plurality of wiper rings 210. The wiper rings 210 may be made of metal impregnated rubber or other wear resistant agent. In certain embodiments, the composition of the wiper rings 210 allows the annular isolator 140 to function through the course of a wellbore operation. In certain embodiments, the wiper rings 210 spring out to rub against the borehole wall 130 during wellbore operations. The wiper rings 210 may form a leaky seal with the borehole wall, which is acceptable since adjacent fluids will be substantially separated. FIG. 2B illustrates a top-down view of an example annular isolator 140 that is non-expandable.

Figure 3B:
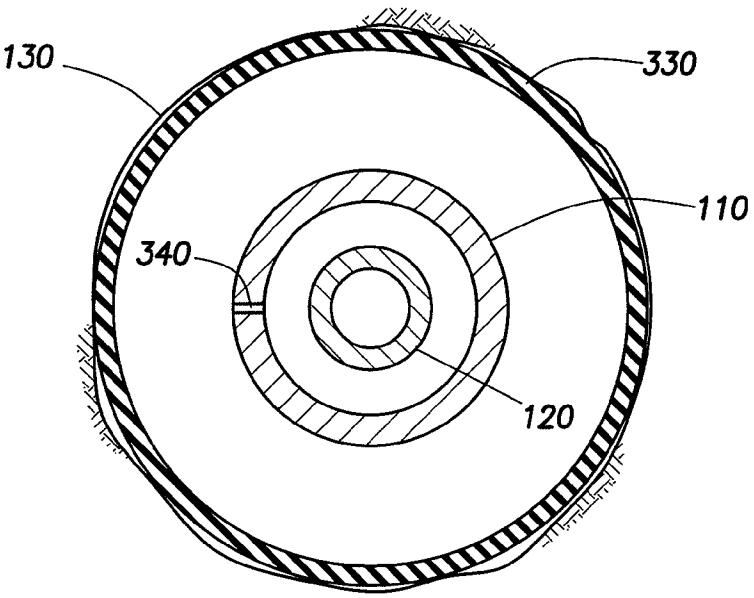
FIG. 3 illustrates an example expandable annular isolator, according to aspects of the present disclosure. (B) illustrates a top-down view of an example expandable annular isolator.
Figure 3A:
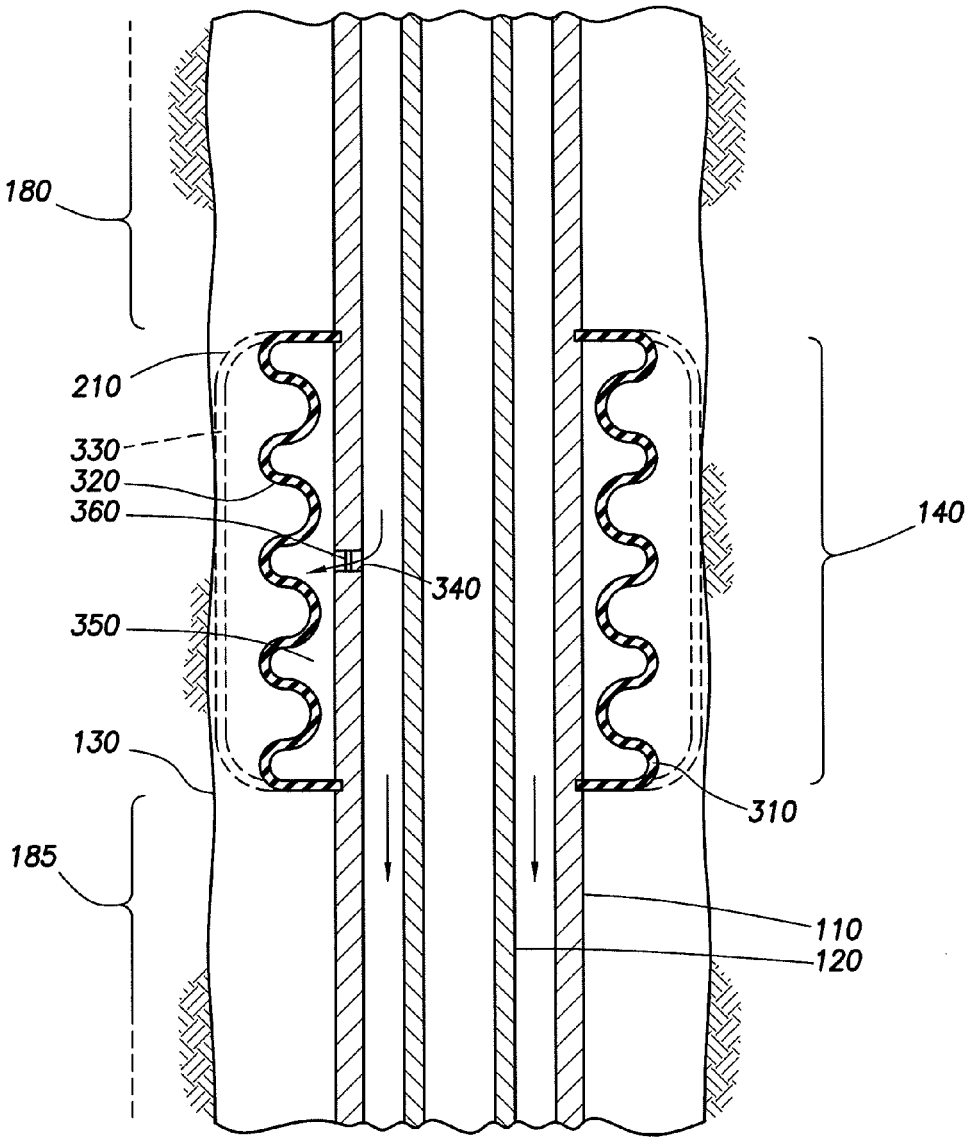

FIG. 3 illustrates an example expandable annular isolator 310. The expandable annular isolator 310 may expand from a relaxed position 320 to an expanded position 330 as fluid is allowed to flow into the isolator interior 350 through an isolator fill port 340. In certain embodiments, the isolator fill port 340 may include an isolator fill control valve 360 that limits fluid flow away from the isolator interior 350. In certain embodiments, the expandable annular isolator 310 is made of metal impregnated rubber or other wear resistant and flexible material. In the expanded position 330, the expandable annular isolator 310 may substantially separate adjacent fluids. The expandable annular isolator 310 in the expanded position 330 may rub against the borehole wall 130 during wellbore operations. In certain embodiments, the expandable annular isolator 310 may be durable enough to function through the course of a wellbore operation without requiring replacement.

Figure 4:
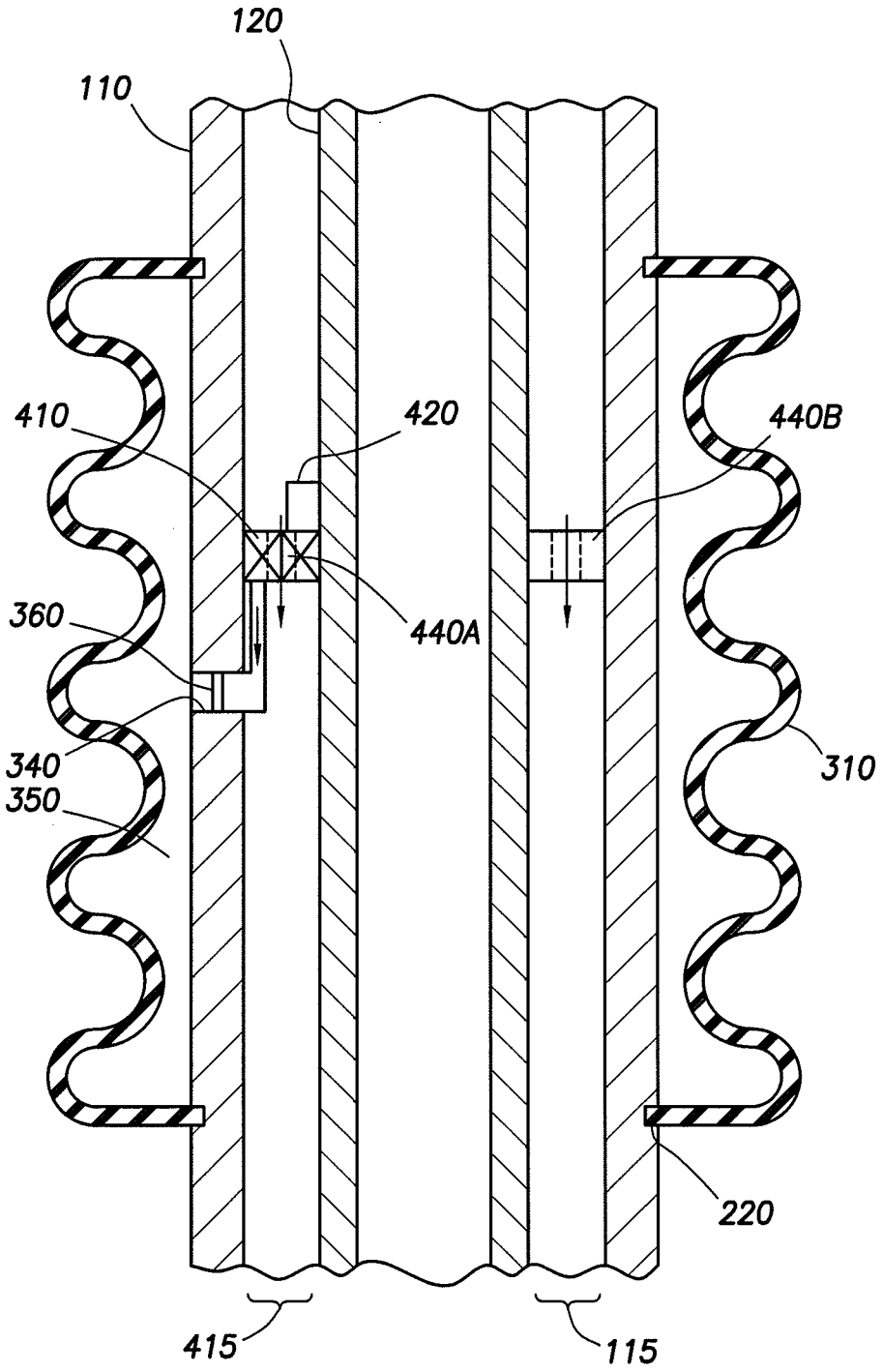
FIG. 4 illustrates an example fluid controller system for expanding an annular isolator, according to aspects of the present disclosure.

FIG. 4 illustrates an example expandable annular isolator 310 of the drilling system 100 containing a fluid communication controller 420 located in the annulus between the inner pipe and the outer pipe 115. The expandable annular isolator 310 may be coupled to the outer pipe 110 at a plurality of annular isolator coupling points 220. The annular isolator coupling points 220 may allow the expandable annular isolator 310 to rotate around the outer pipe 110. In certain embodiments, the annular isolator coupling points 220 may allow the expandable annular isolator 310 to move axially along the outer pipe 110, downhole or uphole. The expandable annular isolator 310 may be torsionally decoupled from the outer pipe 110 while the expandable annular isolator 310 continues to maintain its sealing capability. The fluid communication controller 420 may contain a control valve 410 that can be activated to direct fluid flow into an isolator interior 350 through an isolator fill port 340. In certain embodiments, the fluid communication controller 420 allows selective expansion of an individual expandable annular isolator 310. In certain embodiments, an isolator fill control valve 360 may be located in the isolator fill port 340 to control the flow of fluid out of the isolator interior 350. The fluid communication controller 420 may have flow through paths 440A, 440B that allow fluid to pass the fluid communication controller 420 during expansion of the expandable annular isolator 310.

Figure 5A:
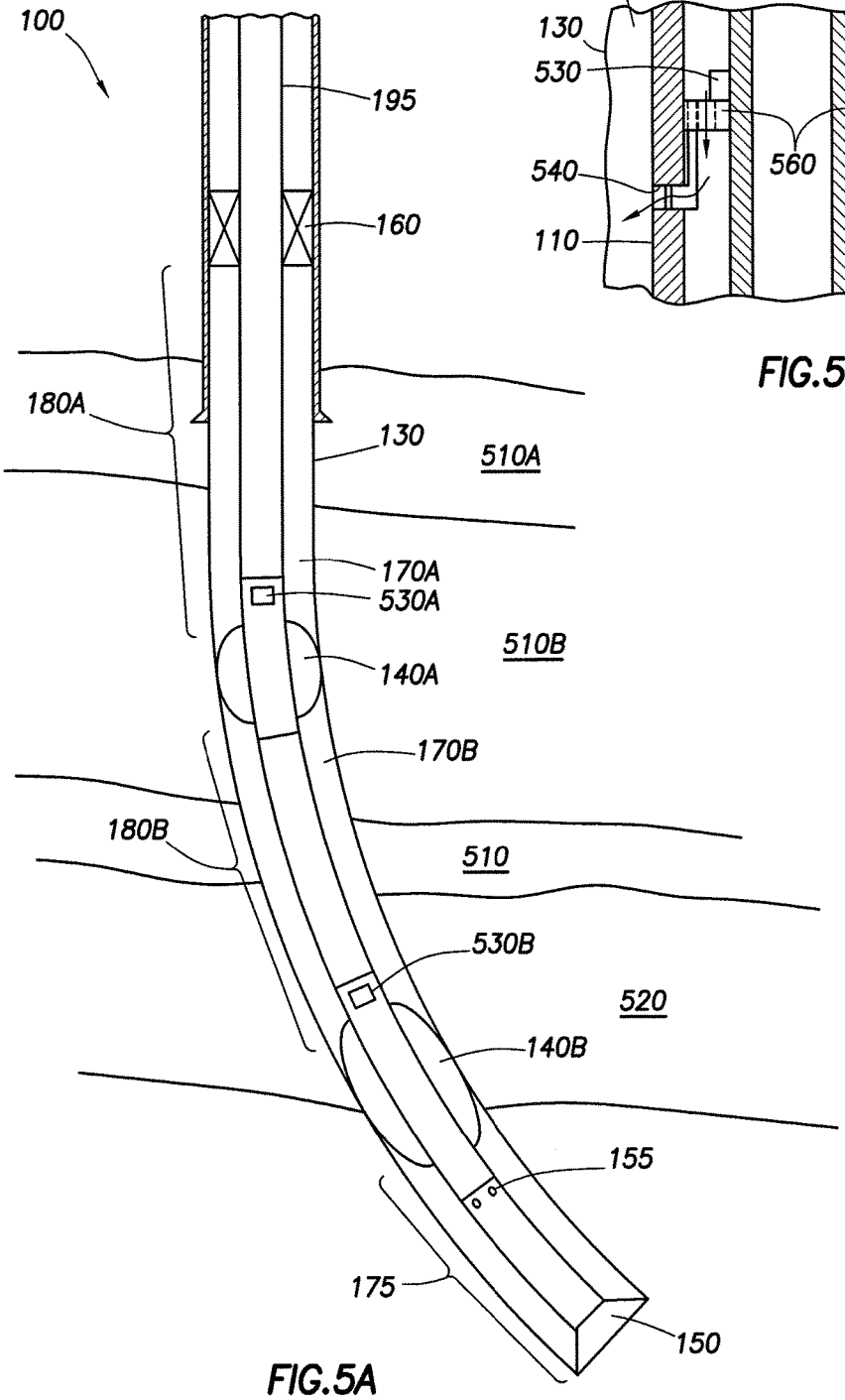
FIG. 5A illustrates an example drilling system with multiple controlled fluid zones created by multiple annular isolators, according to aspects of the present disclosure. (B) illustrates a more detailed view of a control fluid communication controller, according to aspects of the present disclosure.
Figure 5B:
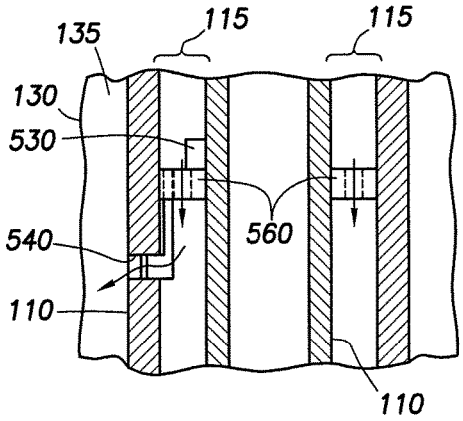

FIG. 5A illustrates an example of the drilling system 100 comprising a plurality of annular isolators 140A, 140B and a plurality of control fluid communication controllers 530A, 530B. The plurality of annular isolators 140A, 140B create a plurality of controlled fluid type zones 180A, 180B. Each controlled fluid type zone 180 may be substantially isolated from other fluids. Each control fluid communication controller 530 may be located in a corresponding controlled fluid type zone 180 to allow selective placement of desired control fluid in each individual controlled fluid type zone 180. FIG. 5B shows an example illustration of a control fluid communication controller 530. The control fluid communication controller 530 may be located in the annulus between the inner and outer pipe 115. The control fluid communication controller 530 may allow fluid to be selectively directed through a borehole annulus fill port 540 and into a borehole annulus 135 corresponding to a desired controlled fluid type zone 180. The control fluid communication controller 530 may contain fluid flow through paths 560 that can be closed while control fluid is directed into a controlled fluid type zone 180, preventing flow of the control fluid past the control fluid communication controller 530. The control fluid communication controller 530 also may be used to move control fluid from a controlled fluid type zone 180 back into the annulus between inner and outer pipes 115 to return the control fluid uphole.

Figure 6:
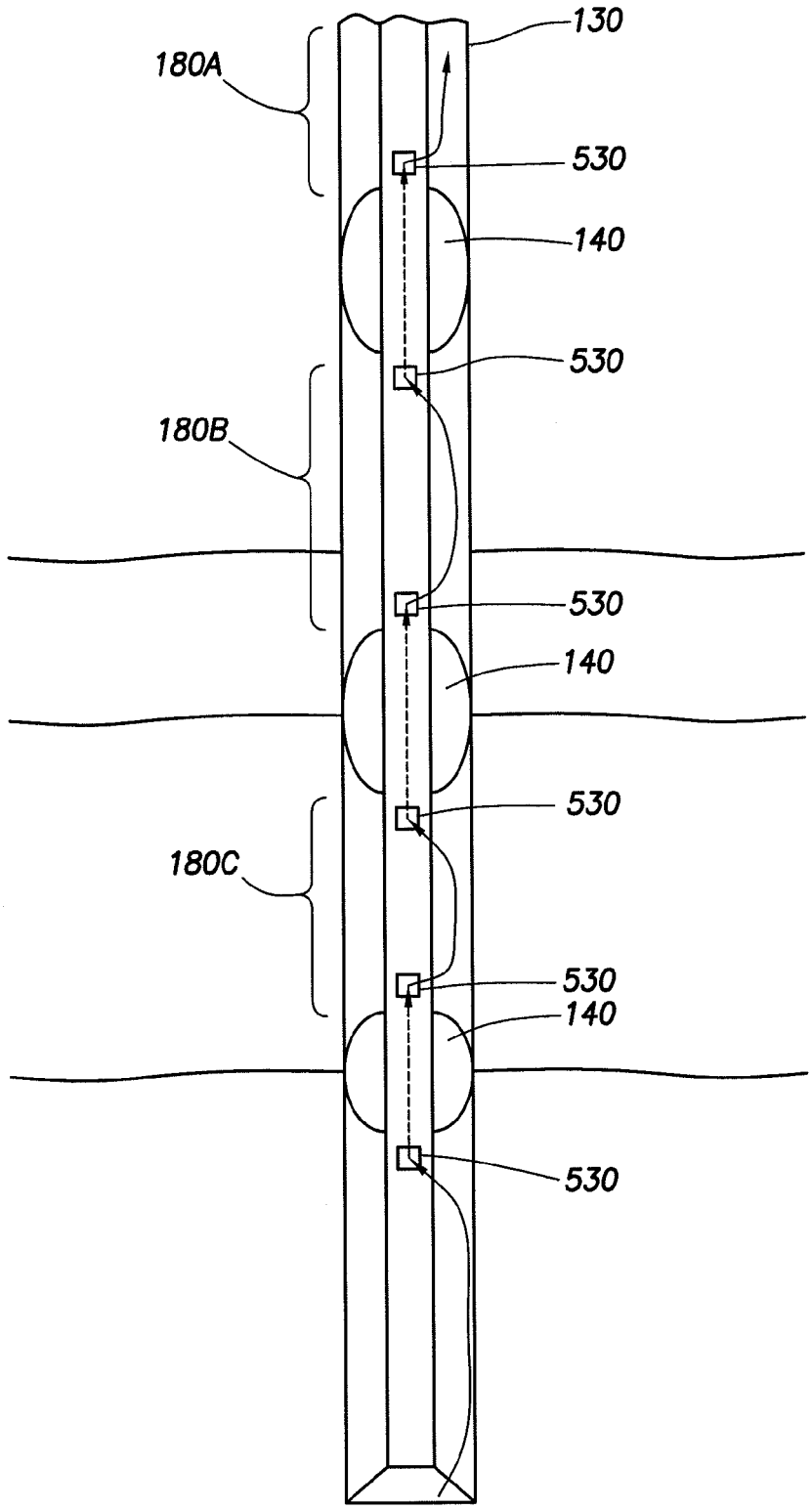
FIG. 6 illustrates an example control fluid movement method, according to aspects of the present disclosure.

FIG. 6 shows an example method of moving control fluids between controlled fluid type zones 180 in the drilling system 100 comprising a plurality of annular isolators 140 and a plurality of control fluid communication controllers 530. The plurality of annular isolators 140 may create a plurality of controlled fluid type zones 180A, 180B, 180C. A plurality of control fluid communication controllers 530 may allow fluid communication between each controlled fluid type zone 180 and the annulus between the inner and outer pipes 115. Moving the control fluid uphole between controlled fluid type zones 180 may allow the control fluid in contact with specific geological formations to remain substantially constant.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system for controlling fluid contact with a borehole wall during wellbore operations, comprising:

an outer pipe;

an inner pipe axially disposed within the outer pipe;

a plurality of annular isolators disposed on the outer pipe and located in a borehole annulus formed between the outer pipe and the borehole wall, wherein the plurality of annular isolators create a plurality of controlled fluid type zones, and wherein each of the plurality of controlled fluid type zones corresponds to at least one of a plurality of geological formations;

a drilling fluid circulated to a drill bit through the inner pipe and an annulus formed between the inner pipe and the outer pipe;

a plurality of control fluids located in the borehole annulus, wherein the plurality of annular isolators separate the plurality of control fluids from the drilling fluid; and a plurality of fluid communication controllers associated with the plurality of annular isolators, wherein the plurality of fluid communication controllers comprises a plurality of fluid flow through paths, wherein each of the plurality of fluid communication controllers is located in a corresponding controlled fluid type zone of the plurality of controlled fluid type zones in an annulus formed between the inner pipe and the outer pipe, wherein a selected fluid communication controller of the plurality of fluid communication controllers allows a first fluid of the plurality of control fluids to be selectively directed through a borehole annulus fill port and into the borehole annulus corresponding to a selected controlled fluid type zone of the plurality of controlled fluid type zones, and wherein a fluid flow through path of the plurality of fluid flow through paths associated with the selected fluid communication controller prevents flow of the first fluid past the selected fluid communication controller.

2. The system of claim 1, wherein the plurality of annular isolators are attached to the outer pipe so as to enable the plurality of annular isolators to rotate around the outer pipe.

3. The system of claim 1, wherein at least one of the plurality of annular isolators comprises a non-expandable annular isolator having a plurality of wiper rings.

4. The system of claim 3, wherein the plurality of wiper rings are metal impregnated rubber.

5. The system of claim 1, wherein at least one of the annular isolators comprises an expandable annular isolator.

6. The system of claim 5, wherein the expandable annular isolator comprises metal impregnated rubber.

7. The system of claim 1, wherein the at least one of the plurality of fluid communication controllers comprises a plurality of control valves that direct a fluid flow into an interior of an associated expandable annular isolator.

8. The system of claim 1, wherein the at least one fluid communication controller allows fluid to flow only into a selected annular isolator of the plurality of annular isolators.

9. The system of claim 1, wherein the plurality of annular isolators are axially spaced along the borehole.

10. The system of claim 1, wherein at least one annular isolator of the plurality of annular isolators is coupled to the outer pipe allowing the at least one annular isolator to move axially along the outer pipe.

11. A method for controlling fluid contact with a borehole wall during wellbore operations, comprising:

introducing an outer pipe into a borehole;

axially positioning an inner pipe within the outer pipe;

coupling a plurality of annular isolators to the outer pipe within an annulus between the outer pipe and the borehole wall, wherein the plurality of annular isolators create a plurality of controlled fluid type zones, wherein each of the plurality of controlled fluid type zones corresponds to at least one of a plurality of geological formations, wherein a plurality of fluid communication controllers are associated with the plurality of annular isolators, and wherein each of the plurality of fluid communication controllers is located in a corresponding controlled fluid type zone of the plurality of controlled fluid type zones;

placing separately a plurality of control fluids in the annulus between the outer pipe and the borehole wall;

circulating a drilling fluid to a drill bit through the inner pipe and an annulus between the inner pipe and the outer pipe, wherein the drilling fluid is separated from the plurality of control fluids by the plurality of annular isolators;

selectively directing, by a selected fluid communication controller of the plurality of fluid communication controllers, a first fluid of the plurality of control fluids through a borehole annulus fill port and into the borehole annulus corresponding to a selected controlled fluid type zone of the plurality of controlled fluid type zones; and preventing flow of the first fluid past the selected fluid communication controller by a fluid flow through path of the plurality of fluid flow through paths associated with the selected fluid communication controller.

12. The method of claim 11, wherein at least one of the plurality of annular isolators comprises an expandable annular isolator.

13. The method of claim 11, wherein the selected fluid communication controller allows the first fluid to flow only into an annular isolator of the plurality of annular isolators associated with the selected fluid communication controller.

14. The method of claim 11, wherein the first fluid is placed into the annulus between the outer pipe and the borehole wall using the selected control fluid communication controller.

15. The method of claim 11, wherein the plurality of annular isolators are axially disposed within the annulus between the outer pipe and the borehole wall.

16. The method of claim 11, further comprising:

moving the plurality of control fluids between the plurality of control zones through the plurality of control fluid communication controllers.

17. The method of claim 11, wherein the drilling fluid is circulated to the drill bit through the inner pipe and returned through the annulus between the inner pipe and the outer pipe.

18. The method of claim 11, wherein the drilling fluid is circulated to the drill bit through the annulus between the inner pipe and the outer pipe and returned through the inner pipe.

19. The method of claim 11, wherein the plurality of annular isolators are moveable axially along the outer pipe.

* * * * *